US011047186B2

(12) United States Patent
Ng et al.

(10) Patent No.: US 11,047,186 B2
(45) Date of Patent: Jun. 29, 2021

(54) ACTUATING A DOWNHOLE TOOL WITH A DEGRADABLE ACTUATION RING

(71) Applicant: Halliburton Energy Services, Inc., Houston, TX (US)

(72) Inventors: Shaun Wen Jie Ng, Singapore (SG); Katherine Ann Davies, Carnoustie (GB)

(73) Assignee: HALLIBURTON ENERGY SERVICES, INC., Houston, TX (US)

( * ) Notice: Subject to any disclaimer, the term of this patent is extended or adjusted under 35 U.S.C. 154(b) by 52 days.

(21) Appl. No.: 16/478,024

(22) PCT Filed: Feb. 9, 2017

(86) PCT No.: PCT/US2017/017128

§ 371 (c)(1),
(2) Date: Jul. 15, 2019

(87) PCT Pub. No.: WO2018/147853

PCT Pub. Date: Aug. 16, 2018

(65) Prior Publication Data

US 2019/0352990 A1 Nov. 21, 2019

(51) Int. Cl.

| | |
|---|---|
| ***E21B 29/02*** | (2006.01) |
| ***E21B 23/06*** | (2006.01) |
| ***E21B 33/12*** | (2006.01) |
| *E21B 34/06* | (2006.01) |
| *E21B 34/14* | (2006.01) |
| *E21B 43/26* | (2006.01) |

(52) U.S. Cl.

CPC ..... *E21B 23/06* (2013.01); *E21B 33/12* (2013.01); *E21B 34/063* (2013.01); *E21B 34/14* (2013.01); *E21B 43/26* (2013.01); *E21B 2200/06* (2020.05)

(58) Field of Classification Search

CPC ..... E21B 29/02
USPC ..... 166/376
See application file for complete search history.

(56) References Cited

U.S. PATENT DOCUMENTS

| | | | | |
|---|---|---|---|---|
| 9,033,055 | B2 * | 5/2015 | Mccoy | E21B 34/14 166/373 |
| 10,221,642 | B2 * | 3/2019 | Zhang | E21B 29/02 |
| 10,519,746 | B2 * | 12/2019 | Hollan | E21B 34/10 |
| 10,641,061 | B2 * | 5/2020 | Bowersock | E21B 34/102 |

(Continued)

FOREIGN PATENT DOCUMENTS

WO WO 2015/073001 A1 5/2015

OTHER PUBLICATIONS

International Search Report and the Written Opinion of the International Search Authority, or the Declaration, dated Oct. 26, 2017, PCT/US2017/017128, 19 pages, ISA/KR.

*Primary Examiner* — Kenneth L Thompson

(57) ABSTRACT

A system and method to actuate a downhole tool, where the tool can include a body, a closure member and a degradable actuation ring. A profile of the actuation ring can be configured to engage an actuation tool (e.g. shifting tool, ball drop, dart, plug, etc.) used to displace the activation ring via the engagement and thereby displacing the closure member to a different position. The degradable actuation ring can be degraded by an agent downhole to degrade and/or remove the actuation ring from the downhole tool thereby providing an increased clearance through the tool.

27 Claims, 6 Drawing Sheets

(56) References Cited

U.S. PATENT DOCUMENTS

| | | | | |
|---|---|---|---|---|
| 2010/0252280 | A1* | 10/2010 | Swor | E21B 43/14 166/386 |
| 2014/0202708 | A1 | 7/2014 | Jacob et al. | |
| 2014/0202712 | A1* | 7/2014 | Fripp | E21B 33/1208 166/377 |
| 2014/0246209 | A1* | 9/2014 | Themig | E21B 33/124 166/374 |
| 2014/0318780 | A1 | 10/2014 | Howard | |
| 2015/0247376 | A1 | 9/2015 | Tolman et al. | |
| 2015/0369003 | A1 | 12/2015 | Hajjari et al. | |
| 2016/0230504 | A1 | 8/2016 | Walton et al. | |
| 2017/0067328 | A1* | 3/2017 | Chauffe | E21B 34/14 |
| 2017/0204700 | A1* | 7/2017 | Hughes | E21B 43/14 |

* cited by examiner

ACTUATING A DOWNHOLE TOOL WITH A DEGRADABLE ACTUATION RING

CROSS REFERENCE TO RELATED APPLICATION(S)

The present application is a U.S. National Stage patent application of International Patent Application No. PCT/US2017/017128, filed on Feb. 9, 2017, the disclosure of which is hereby incorporated by reference in its entirety.

TECHNICAL FIELD

The present disclosure generally relates to systems and methods for using degradable tools in a wellbore, and, more specifically, degradable components that can be used to actuate downhole tools, and thereafter be dissolved or otherwise degraded to remove possible obstructions to subsequent wellbore operations.

BACKGROUND

During some wellbore operations, (e.g. fracturing, treating, producing, injecting, washing, etc.), shifting tools can be used to selectively actuate a downhole tool, such as a sliding sleeve valve, a packer, etc. The shifting tool can engage a profile of the downhole tool to displace an actuator to actuate, activate, set, or otherwise reconfigure the downhole tool to perform a different function (e.g. a valve changed from open to closed, a packer changed from unset to set, etc.). Alternatively, or in addition to, the shifting tool can engage the profile to ensure proper location within the downhole tool allowing telemetry communication between the shifting tool and the downhole tool to command the downhole tool to perform a reconfiguration. In these examples, the shifting tool engagement means must be able to engage the profile of the downhole tool, in order to manipulate downhole tool components and/or enable telemetry communication with the downhole tool. Therefore, shifting tools used further downhole in the wellbore, may not be compatible with profiles of components in downhole tools closer to the surface.

One example of this can be seen when a wash pipe is installed in a wellbore along with a tubing string. An isolation valve in the tubing string can be positioned above a lateral connection in a wellbore, so that, when the washing operation is complete, a shifting tool connected at a lower end of the wash pipe can be used to actuate the isolation valve to a closed position when the wash pipe is removed to the surface through the tubing string. However, the engagement profile of the shifting tool may be too small to engage the profile of the isolation valve, due to decreased diameters farther downhole in the wellbore. Some well systems use a parking sub that is installed with the tubing string and wash pipe. When the wash pipe is removed from the tubing string, the shifting tool engages the parking sub and carries the parking sub with it to increase a radial engagement distance of the shifting tool, thereby allowing it (along with the parking sub) to successfully engage the isolation valve profile and actuate the valve to the closed position. It should be understood that the shifting tool can be seen as one example of an actuation tool.

Another example of an actuation tool for reconfiguring downhole tools by engaging profiles in a downhole tool can be dropped balls. A dropped ball can be carried by a fluid through the tubing string to a downhole tool where the ball can engage a profile (such as "ball seat") and provide increased restriction to flow of the fluid though the tubing string at the point of the engagement. By isolating the tubing string into separate intervals, operations can be performed on one interval while not significantly affecting the tubing string and downhole tools in the other interval. Additionally, multiple engagement profiles can be provided, allowing the tubing string to be divided into multiple wellbore intervals. Generally, engagement profiles that are farther downhole have smaller inner diameters than those profiles that are farther uphole. This allows a smaller ball to pass through all the upper engagement profiles to land in its intended engagement profile. This system allows multiple intervals to be individually operated on, but the increasingly restrictive profiles that are further downhole may provide an undesirable restriction to fluid flow or downhole tool access. It should be understood that the ball can be any object that can be carried by fluid in the tubing string to actuate a downhole tool, such as a ball, dart, plug, etc.

Therefore, it will be readily appreciated that improvements in the arts of actuating downhole tools via engagement profiles are continually needed.

BRIEF DESCRIPTION OF THE DRAWINGS

Various embodiments of the present disclosure will be understood more fully from the detailed description given below and from the accompanying drawings of various embodiments of the disclosure. In the drawings, like reference numbers may indicate identical or functionally similar elements. Embodiments are described in detail hereinafter with reference to the accompanying figures, in which.

DETAILED DESCRIPTION OF THE DISCLOSURE

Figure 1:
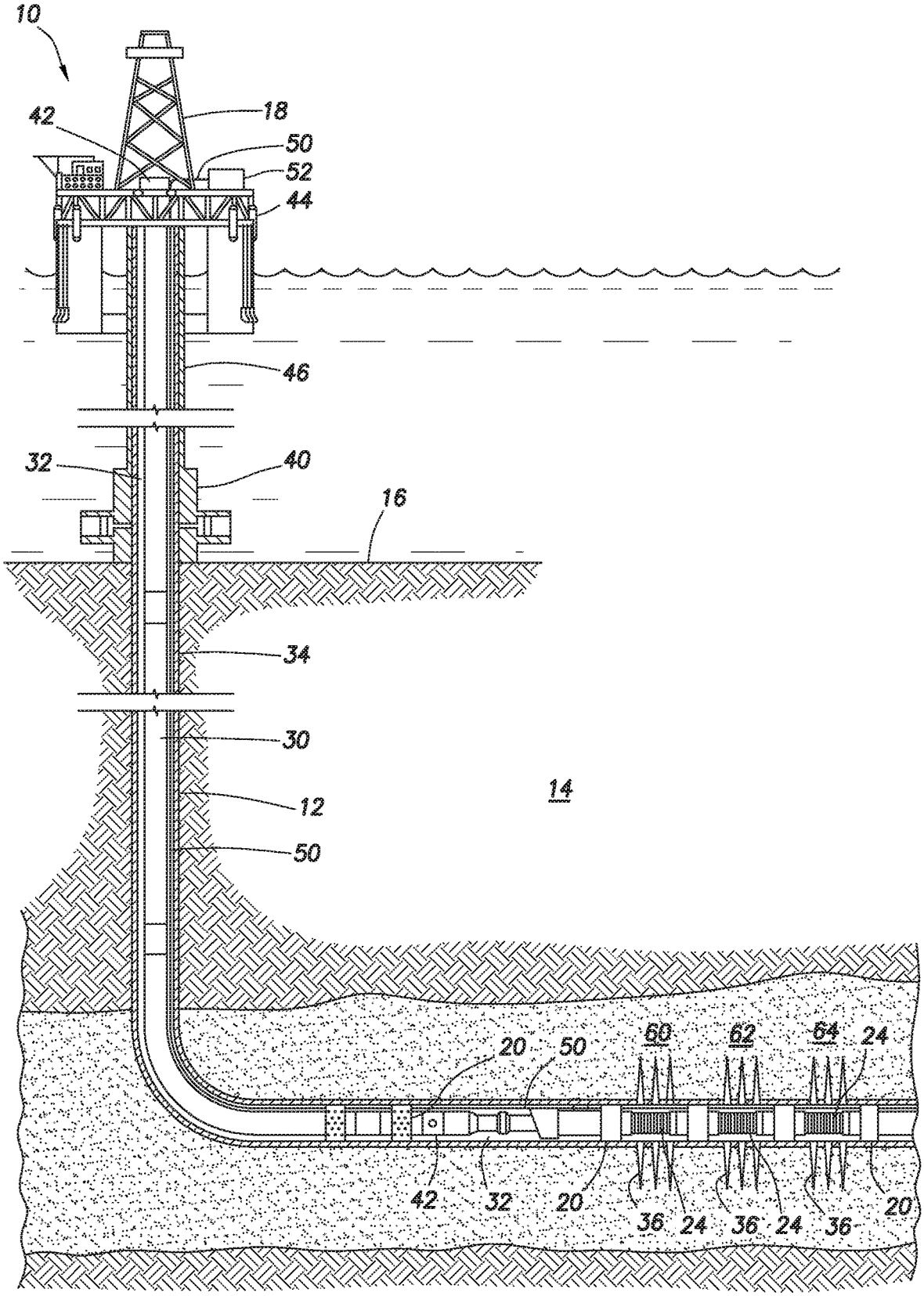
FIG. 1 is a representative partial cross-sectional view of a marine-based well system with multiple wellbore intervals and completion tubing in the wellbore according to an embodiment.

The disclosure may repeat reference numerals and/or letters in the various examples or Figures. This repetition is for the purpose of simplicity and clarity and does not in itself dictate a relationship between the various embodiments and/or configurations discussed. Further, spatially relative terms, such as beneath, below, lower, above, upper, uphole, downhole, upstream, downstream, and the like, may be used herein for ease of description to describe one element or feature's relationship to another element(s) or feature(s) as illustrated, the upward direction being toward the top of the corresponding figure and the downward direction being toward the bottom of the corresponding figure, the uphole direction being toward the surface of the wellbore, the downhole direction being toward the toe of the wellbore. Unless otherwise stated, the spatially relative terms are intended to encompass different orientations of the apparatus in use or operation in addition to the orientation depicted in the Figures. For example, if an apparatus in the Figures is turned over, elements described as being "below" or "beneath" other elements or features would then be oriented "above" the other elements or features. Thus, the exemplary term "below" can encompass both an orientation of above and below. The apparatus may be otherwise oriented (rotated 90 degrees or at other orientations) and the spatially relative descriptors used herein may likewise be interpreted accordingly.

Moreover even though a Figure may depict a horizontal wellbore or a vertical wellbore, unless indicated otherwise, it should be understood by those skilled in the art that the apparatus according to the present disclosure is equally well suited for use in wellbores having other orientations including vertical wellbores, slanted wellbores, multilateral wellbores or the like. Likewise, unless otherwise noted, even though a Figure may depict an offshore operation, it should be understood by those skilled in the art that the method and/or system according to the present disclosure is equally well suited for use in onshore operations and vice-versa. Further, unless otherwise noted, even though a Figure may depict a cased hole, it should be understood by those skilled in the art that the method and/or system according to the present disclosure is equally well suited for use in open hole operations.

As used herein, the words "comprise," "have," "include," and all grammatical variations thereof are each intended to have an open, non-limiting meaning that does not exclude additional elements or steps. While compositions and methods are described in terms of "comprising," "containing," or "including" various components or steps, the compositions and methods also can "consist essentially of" or "consist of" the various components and steps. It should also be understood that, as used herein, "first," "second," and "third," are assigned arbitrarily and are merely intended to differentiate between two or more objects, etc., as the case may be, and does not indicate any sequence. Furthermore, it is to be understood that the mere use of the word "first" does not require that there be any "second," and the mere use of the word "second" does not require that there be any "first" or "third," etc.

The terms in the claims have their plain, ordinary meaning unless otherwise explicitly and clearly defined by the patentee. Moreover, the indefinite articles "a" or "an," as used in the claims, are defined herein to mean one or more than one of the element that it introduces. If there is any conflict in the usages of a word or term in this specification and one or more patent(s) or other documents that may be incorporated herein by reference, the definitions that are consistent with this specification should be adopted.

Generally, this disclosure provides a system and method for engaging profile(s) in a downhole tool to reconfigure the tool, and after reconfiguration of the tool, removing the engagement profile by degradation, thereby decreasing resistance to flow of fluid or a restriction to access of other wellbore tools through the downhole tool.

Turning to FIG. 1, this figure shows an elevation view in partial cross-section of a wellbore production system 10 which can be utilized to produce hydrocarbons from wellbore 12. Wellbore 12 can extend through various earth strata in an earth formation 14 located below the earth's surface 16. Wellbore production system 10 can include a rig (or derrick) 18. The rig 18 can include a hoisting apparatus, a travel block, and a swivel (not shown) for raising and lowering casing, or other types of conveyance vehicles 30 such as drill pipe, coiled tubing, production tubing, and other types of pipe or tubing strings, such as wireline, slickline, and the like. In FIG. 1, the conveyance vehicle 30 is a substantially tubular, axially extending work string or production tubing, formed of a plurality of pipe joints coupled together end-to-end supporting a completion assembly as described below. However, it should be understood that the conveyance vehicle 30 can be any of the other suitable conveyance vehicles, such as those mentioned above. The conveyance vehicle 30 can include one or more packers 20 to prevent (or at least restrict) flow of production fluid through an annulus 32. However, packers 20 are not required.

The wellbore production system 10 in FIG. 1 is shown as an offshore system. A rig 18 may be mounted on an oil or gas platform, such as the offshore platform 44 as illustrated, and/or semi-submersibles, drill ships, and the like (not shown). One or more subsea conduits or risers 46 can extend from platform 44 to a subsea wellhead 40. The tubing string 30 can extend down from rig 18, through subsea conduits 46, through the wellhead 40, and into wellbore 12. However, the wellbore production system 10 can be an onshore wellbore system, in which case the conduits 46 may not be necessary.

Wellbore 12 may be formed of single or multiple bores, extending into the formation 14, and disposed in any orientation (e.g. vertical, inclined, horizontal, combinations of these, etc.). The wellbore production system 10 can also include multiple wellbores 12 with each wellbore 12 having single or multiple bores. The rig 18 may be spaced apart from a wellhead 40, as shown in FIG. 1, or proximate the wellhead 40, as can be the case for an onshore arrangement. One or more pressure control devices (such as a valve 42), blowout preventers (BOPs), and other equipment associated with drilling or producing a wellbore can also be provided in the wellbore production system 10. The valve 42 can be a rotating control device proximate the rig 18. Alternatively, or in addition to, the valve 42 can be integrated in the tubing string 30 to control fluid flow into the tubing string 30 from an annulus 32, and/or controlling fluid flow through the tubing string 30 from upstream well screen assemblies 24.

A computer 52 can be coupled to a cable 50 installed along the tubing string 30 in the wellbore 12. The computer 52 can be used to collect sensor data from sensors in the wellbore, and/or control well system operations. The cable 50 is shown in FIG. 1 extending through the annulus 32 along the tubing string 30, and past wellbore intervals 60, 62, 64 and can provide command and control to various downhole tools. One or more well screen assemblies 24 can be positioned at each location of the wellbore intervals 60, 62, 64.

Prior to the installation of the production string 30 shown in FIG. 1, various completion operations can occur, such as washing, fracturing, treating, gravel packing, etc. These operations can include a tubing string 30 that may include one or more downhole tools (such as a valve 42, a packer 20, etc.) that can require engagement of a profile to reconfigure the tools 42, 20. Each tool 42, 20 can include a body 43 that can support interconnection in the tubing string 30. These profiles can be an integral part of a component of tools 42, 20, or can be separate components that interact with other components of the tools 42, 20. These engagement profiles 70 can be removed by degradation after the desired operations are complete to provide a more open flow passage through the tubing string 30 for less fluid flow restrictions and/or less downhole tool access restrictions. These profiles 70 can be removed without additional tripping in and out of tubing strings to remove the through-bore restrictions in the tubing string 30. Also, the degraded engagement profiles may not leave debris in the wellbore that can interfere with follow-on operations. Therefore, in the case with dropped balls that land on progressively smaller engagement profiles, these profiles can be removed by degradation (e.g. dissolution, corrosion, erosion, reaction, etc.) to remove interference of the engagement profiles to subsequent wellbore operations. Additionally, many other configurations of the wellbore production system 10 can require engagement profiles that may be desirably removed after completing all tasks.

Figure 2:
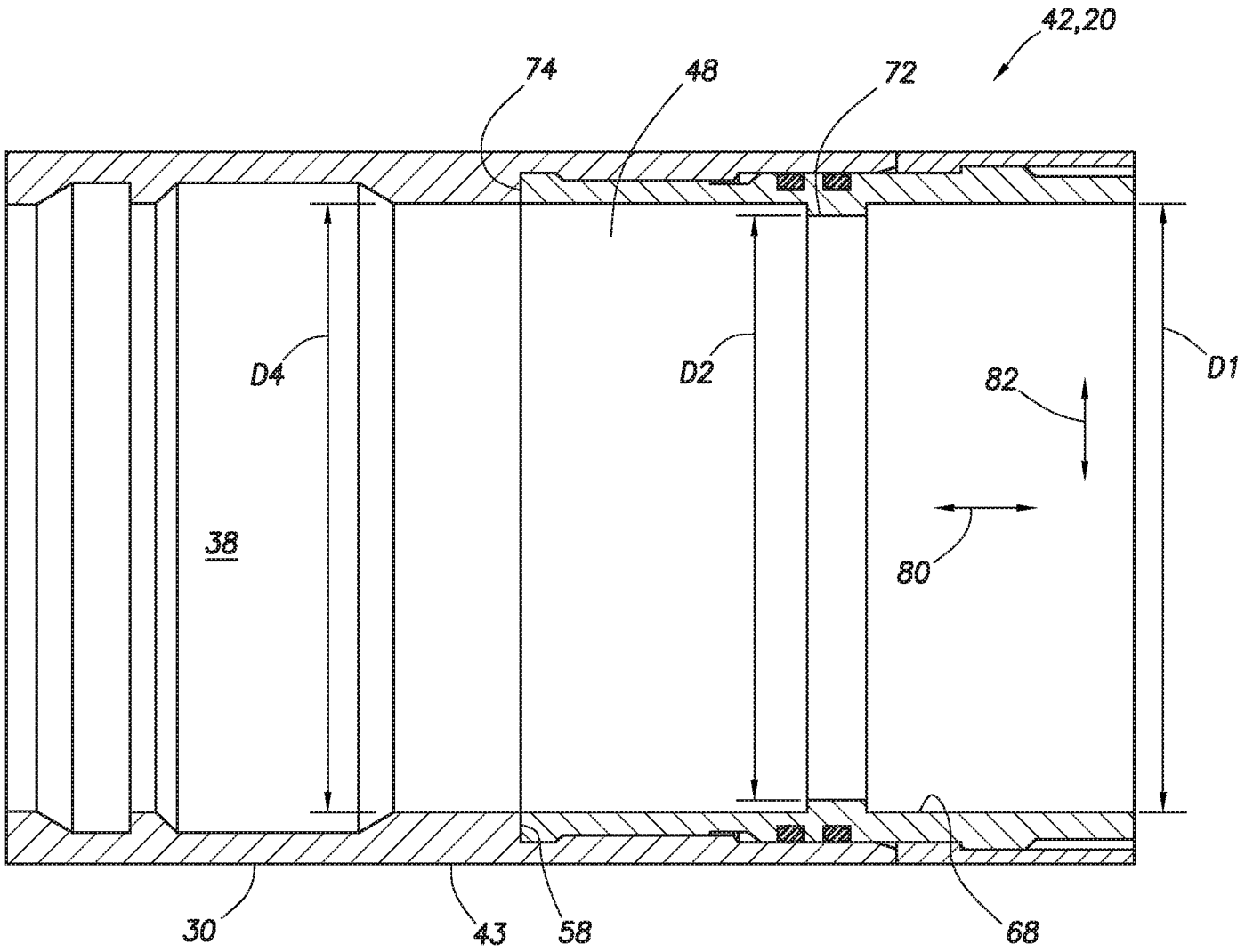
FIG. 2 is a representative partial cross-sectional view of a downhole tool (such as a valve or packer) in a tubing string that can benefit from the principles of this disclosure.

FIG. 2 shows an example of a portion of a downhole tool 42, 20 with a closure member 48 that can be axially and/or rotationally displaced, as indicated by arrows 80, 82, to position the closure member in either an opened, closed or partially opened position. In this example, a profile 72 of the closure member 48 can be engaged by a actuation tool 26 to slide the closure member 48 axially up or down and/or rotationally in the downhole tool 42, 20. The actuation tool 26 (see FIGS. 4 and 5) can be positioned proximate the profile 72 and engage the profile with an engagement means of the actuation tool 26. After engagement, movement of the actuation tool 26 or at least movement of the engagement means can axially and/or rotationally displace the closure member 48. The inner diameter D1 of the closure member 48 can be slightly larger than the inner diameter D2 of the profile 72, which can allow the engagement means 28 of the actuation tool 26 to locate on the profile without also engaging an inner surface 68 of the closure member 48.

Of course, the engagement means can engage the surface 68 as long as that engagement does not prevent engagement with the profile 72. However, after displacing the closure member 48 by the actuation tool 26, the profile 72 remains the smallest diameter restriction through the closure member 48. This tends to drive the design of this profile to protrude as little as possible from the inner surface 68, so that the restriction to flow (or tool access) through the downhole tool 42, 20 is minimized. As stated above, if an actuation tool 26 is small enough to access tools farther downhole from the valve 42, then the engagement means 28 of the actuation tool 26 may not properly engage the profile 72, thereby not properly displacing the closure member 48.

Figure 3:
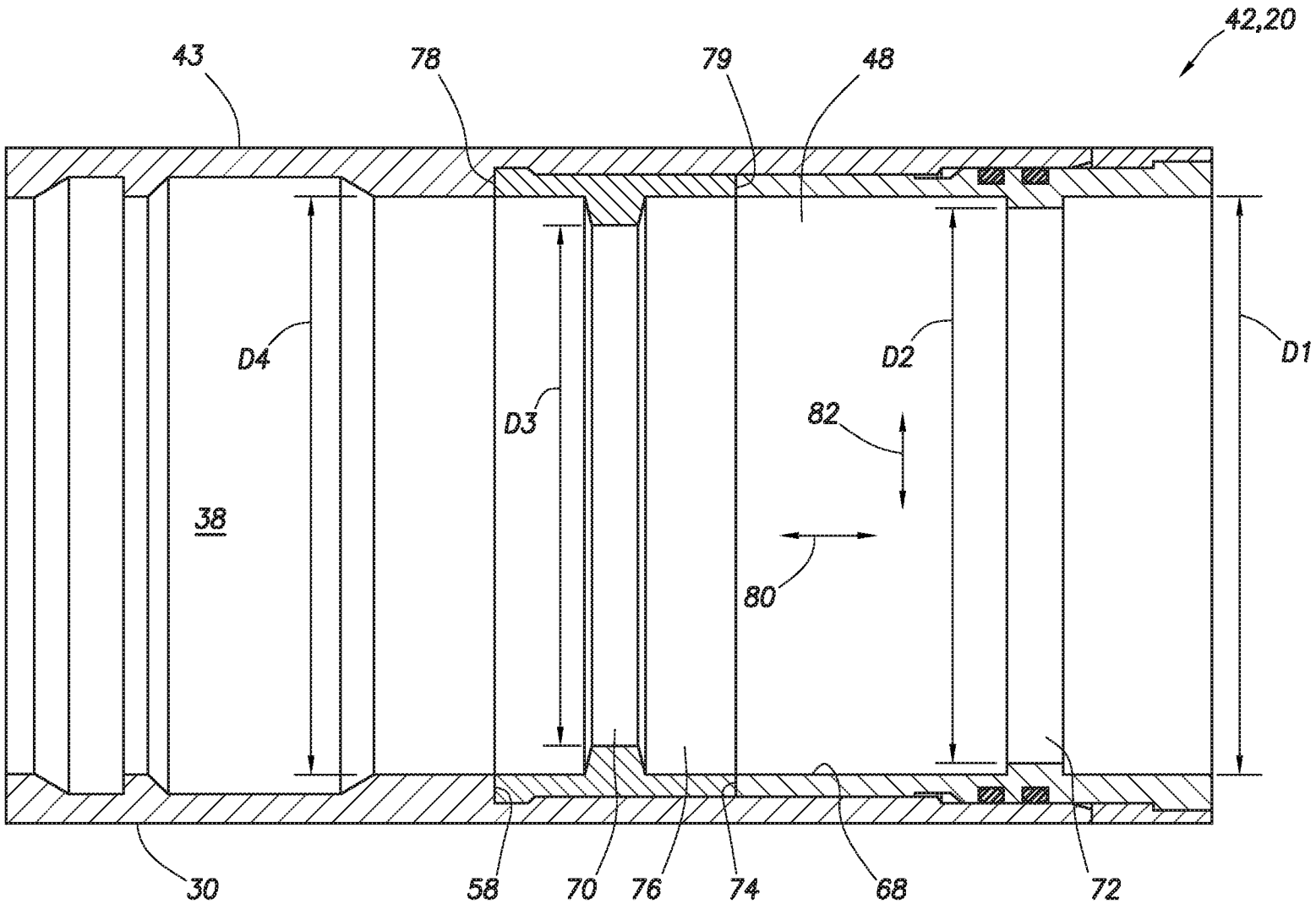
FIG. 3 is a representative partial cross-sectional view of the downhole tool with an engagement profile in the tubing string, according to one or more example embodiments.

The downhole tool 42, 20 shown in FIG. 3 contains an actuation ring 76 with a profile 70 that can be used by a actuation tool 26 to displace the closure member 48. The actuation ring 76 can be made from a material that is degradable, such that the actuation ring 76 can be degraded when it is desired to remove flow obstructions that may be caused by the ring 76 and/or the profile 70. Other features of the ring 76 can be included that extend into the flow passage 38, and these features can also be made of the degradable material and degraded when desired, such as after the actuation tool 26 displaces the closure member 48 to a desired axial and/or rotational position.

As used herein, the term "degradable" and all of its grammatical and functional variants (e.g., "degrade," "degradation," "degrading," "dissolve," dissolving," "dissolution," "corrode," "corrodible," "corrosion," "erode," "erosion," and the like) refers to the dissolution or chemical conversion of solid materials such that reduced-mass solid end products by at least one of solubilization, hydrolytic degradation, biologically formed entities (e.g., bacteria or enzymes), chemical reactions (including electrochemical and galvanic reactions), thermal reactions, or reactions induced by radiation. In complete degradation, no solid end products result. In some instances, the degradation of the material may be sufficient for the mechanical properties of the material to be reduced to a point that the material no longer maintains its integrity and, in essence, falls apart or sloughs off to its surroundings. The conditions for degradation are generally wellbore conditions where an external stimulus may be used to initiate or affect the rate of degradation. For example, the pH of the fluid that interacts with the material may be changed by introduction of an acid or a base. The term "wellbore environment" includes both naturally occurring wellbore environments and materials or fluids introduced into the wellbore. It should also be understood that naturally occurring wellbore fluids can be used to degrade the material without requiring introduction of further materials into the wellbore.

In one or more embodiments, the degradable material may be degradable when acted upon by a degrading agent. The degrading agent may be provided from the surface. The degradable materials can be or include, but are not limited to, magnesium, aluminum, gallium, alloys thereof, or any mixture thereof. In some examples, the degradable material can be or include one or more magnesium alloys and/or one or more aluminum alloys. The dissolving agents can be or include, but are not limited to, one or more acids, one or more bromides, one or more chlorides, or any mixture thereof. For example, the degrading agent can be or include calcium bromide, hydrochloric acid, brine (e.g., sodium chloride and/or other salts in water), or any mixture thereof. Specifically, in one example, completion fluid that contains calcium bromide may be used in an operation, and the degradable material may include a magnesium alloy, which is readily reactive.

The inner diameter D3 of the profile 70 can be any desired distance that supports actuation of the downhole tool 42, 20. The profile 70 can be significantly restrictive to allow complete isolation between separate wellbore intervals when a ball is dropped to seat with the profile 70. After the operations are complete (or at any desired time during the operation), then the ring 76 (or at least the profile 70) can be degraded to remove obstructions in the flow passage 38 of the downhole tool 42, 20 and tubing string 30. As seen in FIG. 3, the profile 70 is slightly larger (i.e. smaller inner diameter) than the profile 72. This reduced diameter profile 70 can be used to properly engage the actuation tool 26 to actuate the downhole tool 42, 20. When it is desired to degrade the actuator ring 76, a degrading agent can degrade the ring 76 and/or profile 70, such that the smallest diameter in the downhole tool 42, 20 can be the profile 72, with the profile 70 removed. It should be understood that, since the profile 70 can be used to actuate the downhole tool 42, 20, then the profile 72 can be removed from the closure member 48 during manufacture, thereby providing an almost full-bore access through the tool 42, 20 when the profile 70 is degraded. A full-bore access can allow larger downhole tools and/or more fluid to pass through the tool 42, 20.

The actuation ring 76 can be installed in the downhole tool 42, 20 in various ways to support actuation of the tool. For example, the ring 76 can be free floating between a shoulder 58 and an end 74 of the closure member 48, as seen in FIG. 3. The ring 76 can be held captive between the shoulder 58 and the end 74, without being securely attached to the closure member 48, thus free floating. Alternatively, the actuator ring 76 can be securely attached to the end 74 of the closure member 48 by threads, adhesive, collets, welding, and any other suitable attachment means, such that any axial and/or rotational movement of the ring 76 will impart an axial and/or rotational movement to the closure member 48.

Figure 4:
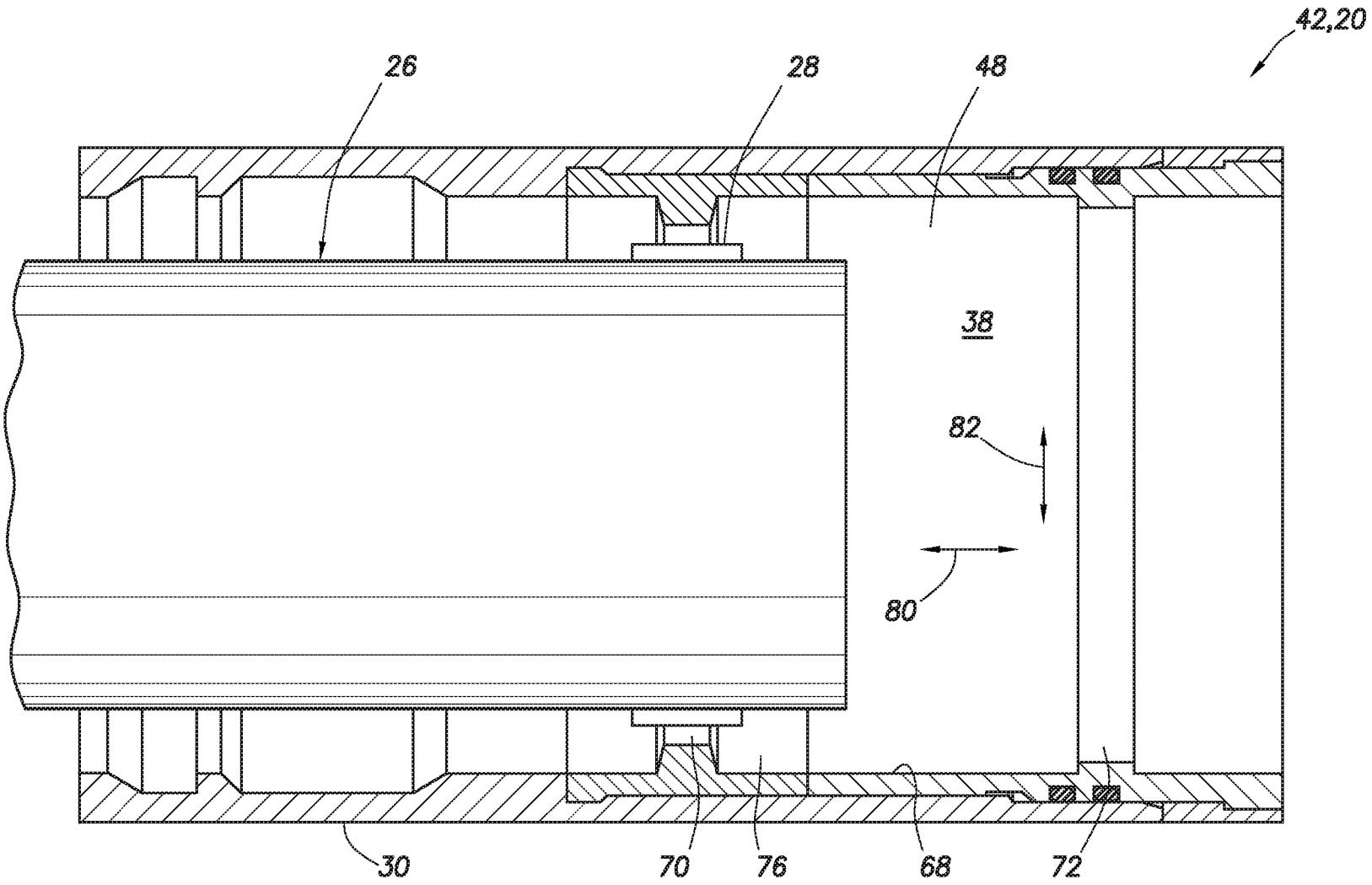
FIG. 4 is a representative partial cross-sectional view of the downhole tool with a degradable engagement profile that can be engaged by an actuation tool, according to one or more example embodiments.

FIG. 4 shows the downhole tool (e.g. valve 42, packer 20, etc.) that includes a degradable actuation ring 76 with a profile 70, and an actuation tool 26 with an engagement means 28. The actuation tool 26 can be positioned within the downhole tool 42, 20 to engage the profile 70 via the engagement means 28 and then displace the actuation ring 76, thereby displacing the closure member 48 in axial and/or rotational directions (see arrows 80, 82).

Figure 5:
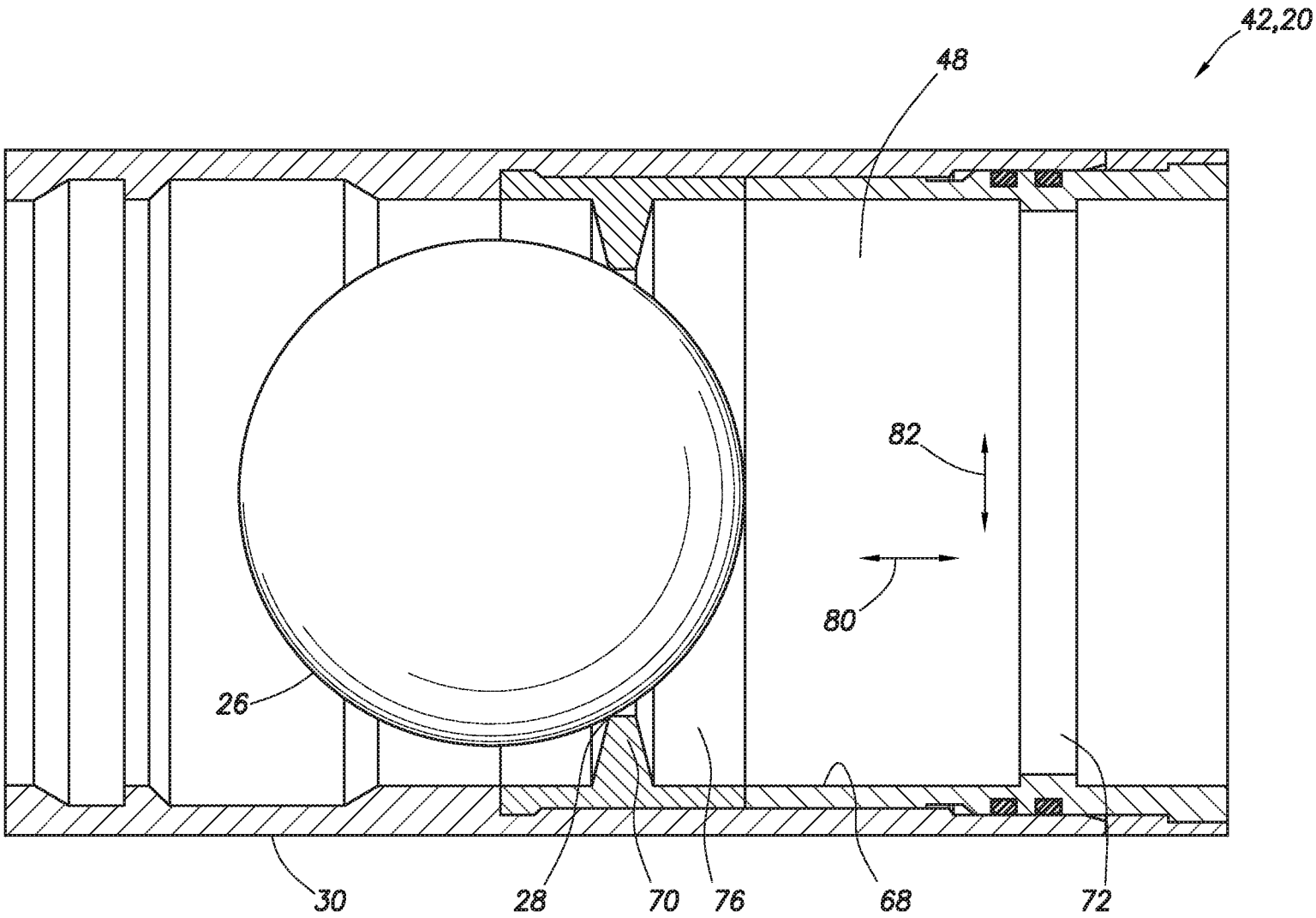
FIG. 5 is a representative partial cross-sectional view of the downhole tool with a degradable engagement profile that can be engaged by another type of actuation tool, according to one or more example embodiments.

FIG. 5 shows the downhole tool (e.g. valve 42, packer 20, etc.) that includes a degradable actuation ring 76 with a profile 70, and another kind of actuation tool 26 with an engagement means 28. The actuation tool 26 in FIG. 5 can be seen as a ball, a dart, or a plug that can be carried through the tubing string 30 to land in the profile 70, thereby engaging the profile 70 with the engagement means 28, which in this example can merely be the outer surface of the actuation tool 26. The engagement of the actuation tool 26 with the profile 70 can be used to displace the actuation ring 76 and thereby displace the closure member 48 into a new configuration.

Figure 6:
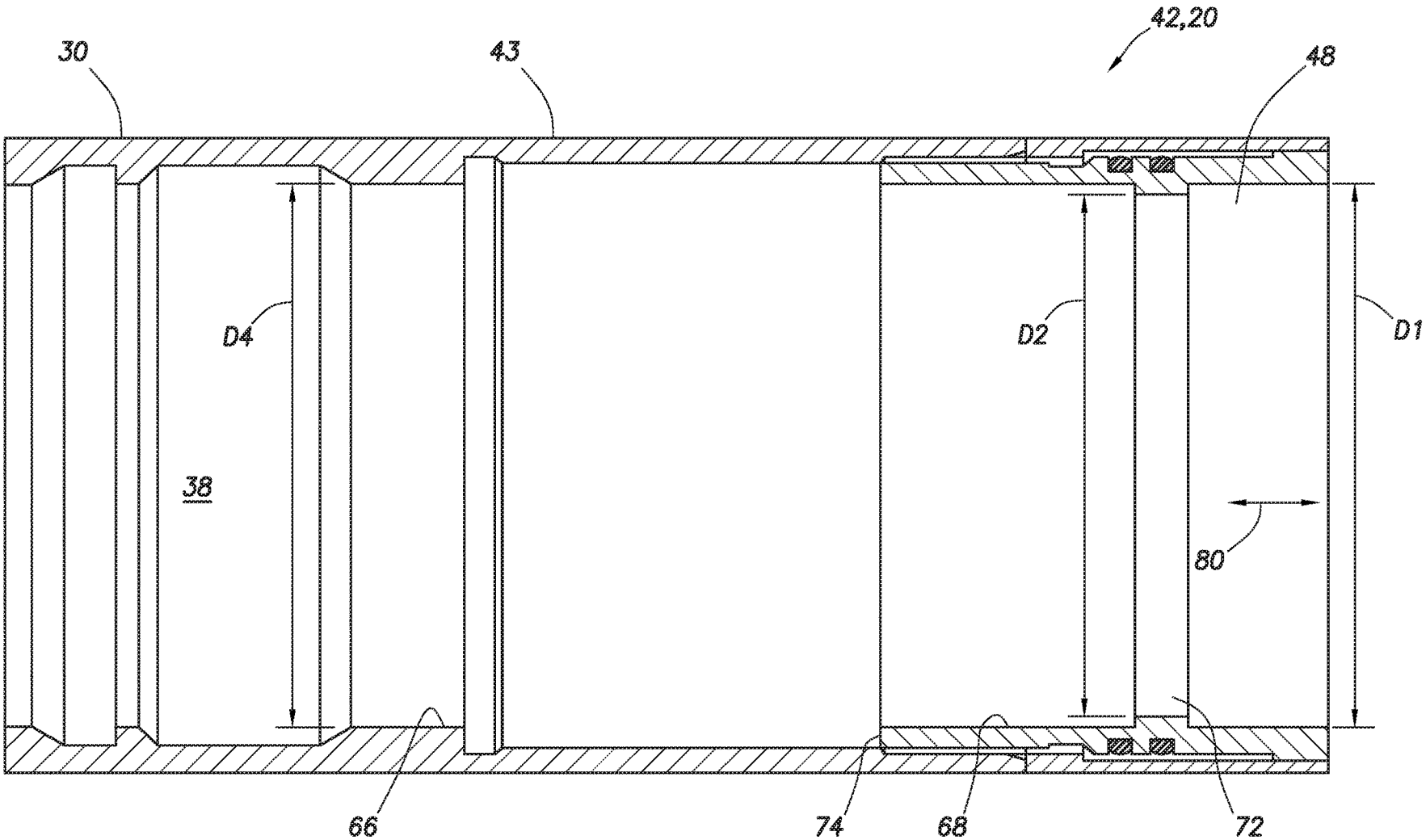
FIG. 6 is a representative partial cross-sectional view of the valve in the tubing string after actuation and after removal of the engagement profile, according to one or more example embodiments.

Referring to FIG. 6, the ring 76 and thus the closure member 48 have been moved axially away from the shoulder 58 with the downhole tool 42, 20 in a changed configuration from the configuration shown in FIG. 3. The changed configuration can be opened, closed, or partially open. It is also illustrated in FIG. 4 that the actuation ring 76 has been degraded to the point of being removed from the downhole tool 42, 20, thereby reducing flow restriction or tool access restriction to the profile 72, instead of the more restrictive profile 70 of the ring 76.

Thus, a downhole tool 42, 20 with a degradable engagement profile 70 is provided. The tool 42, 20 can include a body 43, a closure member 48 within the body 43, and an actuation ring 76 that includes the profile 70, where displacement of the actuation ring 76 via the profile 70 displaces the closure member 48 and a portion of the actuator ring 76 is degraded downhole. Portions of the actuation ring 76 (or the whole actuation ring 76) can be made from a degradable material that can be degraded downhole.

For any of the foregoing embodiments, the downhole tool 42, 20 may include any one of the following elements, alone or in combination with each other:

The downhole tool 42, 20 can be a packer 20, and displacement of the closure member 48 can cause the packer 20 to be set. The displacement can enable pressure communication between a flow passage 38 (or interior) of the tubing string 30 to a chamber in the packer 20, thereby allowing pressure in the tubing string 30 to set the packer 20.

The downhole tool 42, 20 can also be a valve 42, where the displacement of the closure member 48 to a new position actuates the valve 42 to one of a closed, an open, or a partially open position. The valve 42 can maintain the position of the closure member 48 as the actuation ring 76 is being degraded downhole.

The profile 70 of the actuation ring 76 can be configured to engage an actuation tool 26, where the actuation tool 26 includes an engagement means 28 (such as extendable members and/or a surface of the actuation tool 26) that can engage the actuation ring 76 and displace the actuation ring 76 by moving the engagement means 28 relative to the downhole tool 42, 20 or moving the actuation tool 26 relative to the downhole tool 42, 20, where displacement of the ring 76 occurs in response to the engagement of the profile 70 with the actuation tool 26. The displacement of the ring 76 can also occur in response to displacement of at least a portion of the actuation tool 26. The actuation tool 26 can be one of a shifting tool, a setting tool, a ball, a dart, and a plug.

A minimum inner diameter D3 of the downhole tool 42, 20 can be increased due to the degradation of the profile 70. Said another way, a clearance (diameter D3) through the downhole tool 42, 20 can be increased due to the degradation.

The body 43 of the downhole tool 42, 20 can interconnect the downhole tool in a tubing string 30. At least the profile 70 of the actuation ring 76 can be degraded downhole. It should be understood that not all of the profile has to be degraded downhole. Only a portion of the profile can be degraded. However, it is preferred that at least enough of the profile 70 is degraded such that the profile 70 does not determine the minimum inner diameter (D1, D2, D3, D4) of the downhole tool 42, 20.

The actuation ring 76 can be made from a degradable material selected from the group consisting of magnesium, aluminum, gallium, alloys thereof, and any mixture thereof. Other degradable materials, such as PLA (Poly Lactic Acid or polylactide) and/or PLGA (Poly Lactic co-Glycolic Acid) can also be used to manufacture the actuation ring 76.

The actuation ring 76 can be free floating in the body 43 between a shoulder 58 of the body 43 and an end 74 of the closure member 48 or the actuation ring 76 can be securely attached (or coupled) to the end 74 of the closure member 48. Attaching or coupling the closure member 48 to the actuation ring 76 can use various attachment means, such as threads, collets, snapfit connection, pressfit connection, bonding material, welding, etc.

A method for actuating downhole tools 42, 20 via a degradable actuation ring 76 is provided, which can include operations of installing the downhole tool 42, 20 in a wellbore 12, where the downhole tool 42, 20 can include a body 43, a closure member 48, and the actuation ring 76 with a profile 70. The operations can also include engaging the profile 70 with an actuation tool 26, actuating the downhole tool 42, 20 by displacing the closure member 48 via the engaged profile 70, degrading the actuation ring 76, and increasing a diameter D3 of a flow passage 38 through the downhole tool 42, 20 due to the degrading. The diameter (one of D1, D2, D3, D4) of the flow passage 38 can also be seen as a minimum inner diameter D2 of the downhole tool 42, 20, with this minimum inner diameter D3 being increased in response to the degrading. The degrading can also cause a clearance (or minimum inner diameter D3 of the downhole tool 42, 20) to increase.

The downhole tool 42, 20 can be a packer 20 and/or a valve 42 (the valve 42 could possibly be incorporated into the packer 20). The actuating can displace the closure member 48 to one of an open, a closed, or a partially open position. The downhole tool 42, 20 can maintain the displacement of the closure member 48 after the degrading. The actuation tool 26 can be selected from a group consisting of a shifting tool, a setting tool, a ball, a dart, and a plug. The operations can also include degrading the actuation ring 76 by contacting the actuation ring 76 with a degrading agent. The degrading agent can be in the wellbore 12 and/or delivered to the downhole tool 42, 20 in the wellbore 12. The actuation ring 76 can be made from a degradable material selected from the group consisting of magnesium, aluminum, gallium, alloys thereof, and any mixture thereof.

A system for actuating a downhole tool 42, 20 in a wellbore 12, where the system can include the downhole tool 42, 20 connected in a tubing string 30 in the wellbore 12, with the tool 42, 20 including, a closure member 48, and an actuation ring 76 with a profile 70. The actuation tool 26 can be configured to engage the profile 70 and displace the actuation ring 76 via the engagement with a configuration of the downhole tool 42, 20 being changed in response to the displacement. Additionally, a degrading agent can degrade the actuation ring 76 (or at least a portion of it) upon contact with the actuation ring.

For any of the foregoing embodiments, the method may include any one of the following elements, alone or in combination with each other:

The downhole tool 42, 20 in the system can be one of a packer 20 and a valve 42, and the displacement of the actuation ring 76 changes a position of the closure member 48 between one of an open, a closed, and a partially open position. The closure member 48 in the packer 20 can provide pressure access to a chamber that can be pressurized through the tubing string 30 to set the packer 20. The closure member 48 in the valve 42 can provide variable adjustment to fluid flow through the valve.

A clearance through the downhole tool 42, 20 can be increased due to the degradation. The clearance can also be represented by a minimum inner diameter D3, D2 of the downhole tool 42, 20, therefore, increased clearance can also be represented by an increased minimum inner diameter D3, D2 of the downhole tool. The actuation tool 26 can be selected from a group consisting of a shifting tool, a setting tool, a ball, a dart, and a plug.

Although various embodiments have been shown and described, the disclosure is not limited to such embodiments and will be understood to include all modifications and variations as would be apparent to one skilled in the art. Therefore, it should be understood that the disclosure is not intended to be limited to the particular forms disclosed; rather, the intention is to cover all modifications, equivalents, and alternatives falling within the spirit and scope of the disclosure as defined by the appended claims.

The invention claimed is:

1. A downhole tool comprising:

a body defining a shoulder therein:

a closure member within the body, the closure member including a first profile extending radially inward from an inner diameter of the closure member; and an actuation ring within the body disposed axially between the shoulder of the body and an axial end of the closure member, the actuation ring having a second profile, such that displacement of the actuation ring via the second profile displaces the closure member, and at least a portion of the actuation ring is degraded downhole.

2. The tool of claim 1, wherein the downhole tool is a packer, and wherein the displacement of the closure member causes the packer to be set.

3. The tool of claim 1, wherein the downhole tool is a valve.

4. The tool of claim 3, wherein the displacement of the closure member to a new position actuates the valve to one of a closed, an open, or a partially open position.

5. The tool of claim 4, wherein the valve maintains the new position of the closure member as the actuation ring is degraded.

6. The tool of claim 1, wherein the second profile is configured to engage an actuation tool and the displacement of the actuation ring occurs in response to engagement of the second profile with the actuation tool.

7. The tool of claim 6, wherein the actuation tool is selected from a group consisting of a shifting tool, a setting tool, a ball, a dart, and a plug.

8. The tool of claim 1, wherein a minimum inner diameter of the downhole tool is increased due to degradation of the second profile.

9. The tool of claim 1, wherein a clearance through the downhole tool is increased due to degradation of the profile.

10. The tool of claim 1, wherein the body interconnects the downhole tool in a tubing string.

11. The tool of claim 1, wherein at least the second profile of the actuation ring is degraded downhole.

12. The tool of claim 1, wherein the actuation ring is made from a degradable material selected from the group consisting of magnesium, aluminum, gallium, alloys thereof, and any mixture thereof.

13. The tool of claim 1, wherein the actuation ring is free floating in the body between the shoulder of the body and an end of the closure member.

14. The tool of claim 1, wherein the actuation ring is securely coupled to the axial end of the closure member.

15. A method of actuating a downhole tool, the method comprising:

installing the downhole tool in a wellbore, the downhole tool comprising, a body defining a shoulder therein, a closure member within the body, the closure member including a first profile extending radially inward from an inner diameter of the closure member, and an actuation ring within the body disposed axially between the shoulder of the body and an axial end of the closure member, the actuation ring having a second profile;

engaging the second profile with an actuation tool;

actuating the downhole tool by displacing the closure member to a new position via the engaging;

degrading the actuation ring; and increasing a diameter of a flow passage through the downhole tool due to the degrading.

16. The method of claim 15, wherein the downhole tool is a packer.

17. The method of claim 15, wherein the downhole tool is a valve.

18. The method of claim 17, wherein the actuating displaces the closure member to one of an open, a closed, or a partially open position.

19. The method of claim 15, further comprising, maintaining the new position of the closure member after the degrading.

20. The method of claim 15, increasing a clearance through the downhole tool due to the degrading.

21. The method of claim 20, wherein the actuation tool is selected from a group consisting of a shifting tool, a setting tool, a ball, a dart, and a plug.

22. The method of claim 15, wherein the degrading further comprises contacting the actuation ring with a degrading agent.

23. The method of claim 15, wherein the actuation ring is made from a degradable material selected from the group consisting of magnesium, aluminum, gallium, alloys thereof, and any mixture thereof.

24. A system for actuating a downhole tool in a wellbore, the system comprising:

the downhole tool connected in a tubing string in the wellbore, the downhole tool comprising, a body defining a shoulder therein;

a closure member within the body the closure member including a first profile extending radially inward from an inner diameter of the closure member; and an actuation ring within the body disposed axially between the shoulder of the body and an axial end of the closure member, the actuation ring having a second profile;

an actuation tool configured to engage the second profile and displace the actuation ring via engagement with the second profile, with a configuration of the downhole tool being changed in response to displacement of the actuation ring; and a degrading agent that degrades the actuation ring upon contact with the actuation ring.

25. The system of claim 24, wherein the downhole tool is one of a packer and a valve, and the displacement of the actuation ring changes a position of the closure member between one of an open, a closed, and a partially open position.

26. The system of claim 24, wherein a clearance through the downhole tool is increased due to degradation of the actuation ring.

27. The system of claim 26, wherein the actuation tool is selected from a group consisting of a shifting tool, a setting tool, a ball, a dart, and a plug.

* * * * *